United States Patent [19]

Lin-Liaw

[11] 4,241,703

[45] Dec. 30, 1980

[54] DEVICES FOR PROMOTING COMPRESSION RATIO OF FUEL MIXTURE IN ENGINES

[76] Inventor: Jiing Lin-Liaw, No. 18 Lane 136, Yung Ho St., Taichung City, Taiwan

[21] Appl. No.: 964,448

[22] Filed: Nov. 22, 1978

[51] Int. Cl.[3] ..... F02B 75/04

[52] U.S. Cl. ..... 123/48 R; 123/292; 123/78 A; 123/78 AA

[58] Field of Search ..... 123/78 R, 78 A, 78 AA, 123/78 D, 48 A, 48 AA, 26, 48 R, 33 VC

[56] References Cited

U.S. PATENT DOCUMENTS

| | | | |
|---|---|---|---|
| 1,415,025 | 5/1972 | Folsum | 123/78 AA |
| 1,609,686 | 12/1926 | Blanding | 123/48 A |
| 1,983,351 | 12/1934 | Edwards | 123/78 D |
| 2,991,767 | 7/1961 | Candelise | 123/26 |
| 4,103,648 | 8/1978 | Jarry | 123/48 R |

FOREIGN PATENT DOCUMENTS

| | | | |
|---|---|---|---|
| 210197 | 1/1924 | United Kingdom | 123/78 AA |

*Primary Examiner*—Ronald H. Lazarus

*Attorney, Agent, or Firm*—Cushman, Darby & Cushman

[57] ABSTRACT

A device to fit existing engines for the purpose of increasing compressed fuel-mixture pressure and promoting a compression ratio of the fuel-mixture in an engine to enable the fuel-mixture to burn more perfectly and the engine to works more efficiently.

In the prior application of the same petitioner, titled "Pressure Addible Engine" with the same purpose to the invention but built in an unit engine which shall request people to throw the used engine away. In incentive of that, present invention modifies the prior invention into independent device unit, suitably fit to existing gasoline engine or diesel engine and makes the invention to be acceptable popularly.

9 Claims, 2 Drawing Figures

DEVICES FOR PROMOTING COMPRESSION RATIO OF FUEL MIXTURE IN ENGINES

BACKGROUND OF THE INVENTION

Since a relatively high compressed fuel-mixture in an engine makes a relatively perfect combustion of the mixture and provides relatively high efficiency of the engine. But in practice, when compression ratio overs 10 of a gasoline-fuel or 22 of a diesel-fuel, the fuel-mixture will burn and power to resist further travel inward of the engine piston and make not only power loses also the shock of the engine. In prior co-pending application, Ser. No. 950,434 is disclosed which is a "pressure Addible Engine" functional in increasing the pressure of compressed fuel-mixture right as the piston travels to its maximum inward position by supplying high pressure from a pressure storage chamber, which thereby causes the engine power not to resist the piston inward travel but provides higher power for piston outward travel. However, the prior invention is built in an unit engine and with little utility for retrofitting existing engines.

SUMMARY OF THE INVENTION

The present invention is divided into two types of pressure adding units individually applying for fitting existing gasoline engines and diesel engines to achieve the same result as the prior invention "Pressure Addible Engine".

The unit for a gasoline engine has a pressure storage chamber carrying a sparking plug with a threaded pipe part for fitting into a fit hole of a gasoline engine which is normally adapted for fitting a sparking plug. Through a center channel of the threaded pipe the high pressure gases from engine power can flow into the pressure storage chamber or flow back to the engine chamber. A valve inside the pressure storage chamber on the pipe head is timingly opened and closed by an electromagnet lifting device to control the storage and the flow of high pressure gases.

Another embodiment for diesel engines has a pressure storage chamber carrying a fuel injection-nozzel with a threaded pipe part for fitting into a fit hole of a diesel engine which normally is adapted for fitting a fuel injection nozzle. One valve is equipped and functional the same as the valve of the gasoline engine but is operated timingly by a hydraulic lifting device.

Both devices feature an independent unit which suitably fits into a respective engine without any modification of the engine, thus giving the invention great utility.

Other important objects and functional and structural features of the invention will become apparent from the following specification taken with the accompanying drawings wherein.

DETAILED DESCRIPTION OF THE INVENTION

Figure 1:
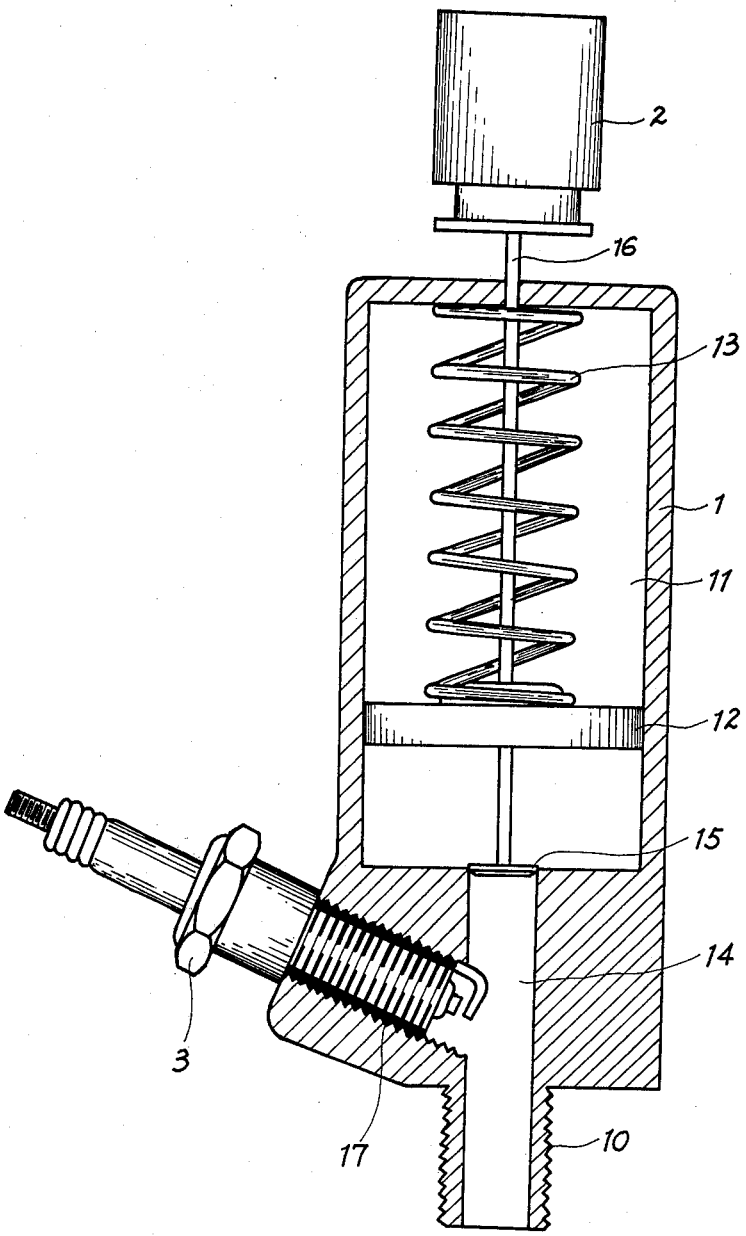
FIG. 1 is a cut away view of present invention unit used in gasoline engine.

On FIG. 1, present invention device featuring a cylinder like unit with a heat insulation cylinder body 1 on the upper portion and a threaded pipe 10 on the lower end. One pressure storage chamber 11 is formed inside the heat insulation cylinder body 1 for storing and preserving high pressure hot gas. One gases channel 14 in the lower part of the unit connects the pressure storage chamber 11 to the burning chamber of a gasoline engine when the unit is fitted to the engine, while the threaded pipe part 10 as serves the fitting element and suitably screws into a threaded hole of the engine normally equipped for fitting a sparking plug.

Sparking plug 3 is fitted into a new fitting hole 17 crossly bored beneath the pressure storage chamber 11 to the middle of the gas channel 14, providing an ignition source to the engine. One valve 15, inside the storage chamber 11 on the top of the gases channel 14 with one valve rod 16 extending outside to an electromagnet lifter 2, serves for gas flow control. One piston 12 inside the storage chamber works against a spring 13 which provides the piston with downward energy as.

Energy of the electromagnet lifter 2 is supplied parallel to that of the sparkling plug from the distributor of the engine ignition system. The wiring synchronous makes the center electrode of the sparking plug 3 at peak charge and the valve 15 open, whereby the stored high pressure gases discharge to add compressed fuel-mixture just as the ignition is taking place.

During the engine power stroke, the high pressure hot gases concurrently charge into the storage chamber 11 and force the engine piston to travel outwardly, and the storage chamber 11 will soon be charged to its peak pressure just as the distributor switches off energy supply to the sparking plug 3 and the electromagnet lifter 2. Then, the valve 15 is forced to close the gas channel 14 and high pressure hot gases therefore are stored securely in the storage chamber 11 so that they can apply increased fuel-mixture pressure during the next cycle.

Figure 2:
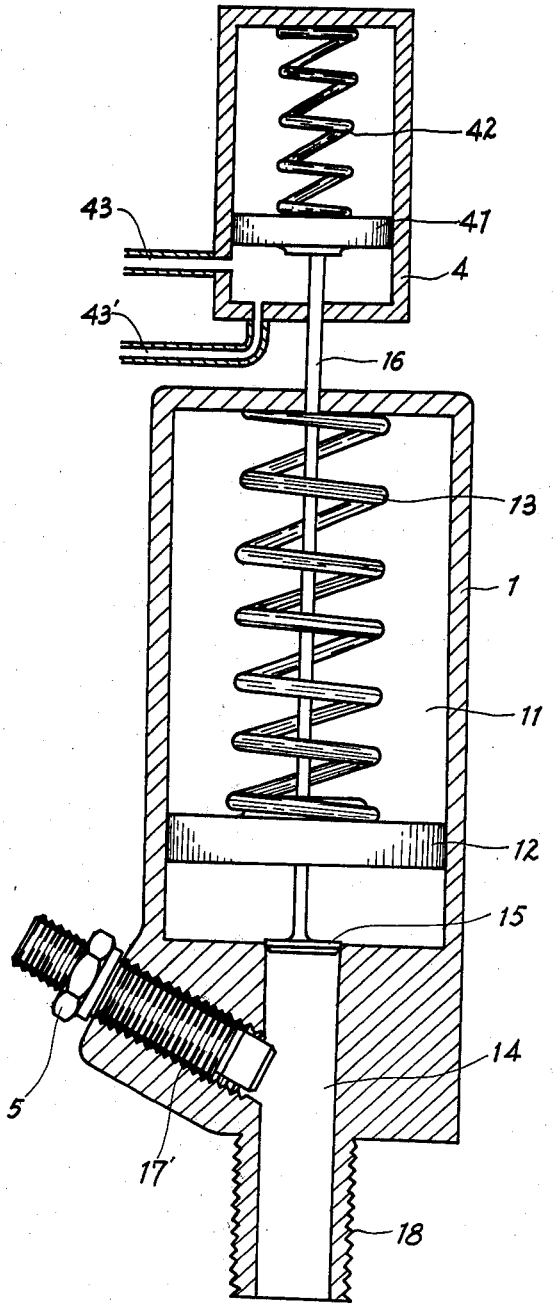
FIG. 2 is a cut away view of present invention unit used in diesel engine.

FIG. 2, showing the present invention unit of a diesel type, when viewed in every respect is very similar to the invention unit of the gasoline type. The two embodiments differ in that the diesel embodiment includes threaded pipe 18, for fitting into the fitting hole of a diesel engine normally equipped for fitting a fuel injection nozzel, new fitting hole 17' for fitting a fuel injection nozzel 5, and hydraulic lifter 4 for controlling the valve 15 action by energy supplied by fuel deliverer 43 parallel to that of fuel injection nozzle 5 from the fuel distributor of the fuel supply system of the engine. The operation of this type unit is also very similar to the gasoline type embodiment. When the engine piston arrives at its maximum inward position, the distributor switches on and supplies high pressure fuel synchronous to operate the fuel injection nozzel 5 and the hydraulic lifter 4, the injection nozzel 5 soon sprays fuel to the engine chamber and the storage chamber 11 discharges high pressure gases to the engine chamber to add to the fuel-mixture pressure and then the ignition happens.

During the power stroke, high pressure hot gases recharge into the storage chamber 11 and are stored in the chamber by closing the valve 15 as the fuel distributor switches off fuel supply to the lifter 4, so that spring 42 presses down on piston 41 together with the valve rod 16 to close the valve 15. Also, another fuel-deliverer 43' for returning fuel to the fuel tank enables piston 41 to drop down.

In both types of the present invention units, the stored high pressure hot gases from engine power stroke of each cycle make the next engine power stroke stronger. The stored high pressure hot gases do not directly increase the power of the engine but indirectly increase the compression ratio of fuel-mixture and make the combustion of the fuel mixture more perfect and produce the pressure be stored for next turn use.

I claim:

1. A device for fitting in a first socket communicating with a combustion space of an internal combustion engine for increasing the gas pressure in said combustion space when a fuel air mixture is combusted therein, said first socket being adapted to removably receive a combustion assisting member; said combustion space being defined between a portion of the internal surface of a combustion chamber and a power member sealingly fitted in the chamber for cyclical movement between a first position in which the volume of said combustion space is a minimum and a second position in which the volume of said combustion space is a minimum; said device comprising a housing defining an internal storage chamber for storing high pressure combusted gas, said housing having a portal formed in the walls of said storage chamber, said housing including an appendage having an outer surface adapted to be fitted into said first socket, a passage being formed in said appendage, one end of said passage terminating at said portal, the other end of said passage communicating with said combustion space; said appendage having a second socket formed therein for receiving said combustion assisting member so that said combustion assisting member communicates with said passage; and valve means for opening said portal when said power member is in said first position before combustion of said fuel air mixture to permit said high pressure combusted gas to flow into said combustion space to increase the total pressure in said combustion space during combustion of said fuel air mixture and for permitting said high pressure combusted gas to flow from said combustion space into said storage space immediately after said combustion, and for closing said portal after said combustion to trap said high pressure combusted gas in said storage chamber when said power member is moving between said first and second positions.

2. A device as in claim 1 wherein said internal combustion engine comprises a spark ignition engine, said combustion assisting member comprising a spark plug for combusting said fuel air mixture, said second socket being adapted to fit therein said spark plug.

3. A device as in claim 1 wherein said internal combustion engine comprises a compression ignition engine, said combustion assisting member comprising means for injecting fuel into said combustion space, said second socket being adapted to fit therein said fuel injecting means.

4. A device as in claim 1 or claim 2 or claim 3 further comprising a resilient spring mounted auxiliary piston formed in said storage chamber for storing energy when said high pressure combusted gas is stored in said storage chamber.

5. A device as in claim 2 wherein said value means comprises means for synchronously opening said portal when said spark plug is sparking and for closing said portal when said sparking is discontinued.

6. A device as in claim 5 wherein said internal combustion engine further comprises a distributor, and said synchronously opening means comprises a valve member disposable over said portal and electromagnetic means, electrically connectable to said distributor when said distributor is supplying electrical power to said spark plug, for lifting said valve member off of said portal to open said portal, said high pressure combusted gas in said storage chamber forcing said plug onto said portal to close said portal when said electromagnetic means is electrically disconnected from said distributor.

7. A device as in claim 3 wherein said valve means comprises means for synchronously opening said portal when said injecting means is injecting fuel into said combustion space, and for closing said portal when said injecting is discontinued.

8. A device as in claim 7 wherein said engine comprises a hydraulic fuel supply system for supplying fuel to said fuel injecting means, said valve means comprising means, coupled to said fuel supply system, for hydraulically opening said portal when said system is supplying fuel to said injecting means and closing said portal when said system is not supplying fuel to said injecting means.

9. A device as in claim 8 wherein said hydraulically opening means comprises a cylinder, a piston sealingly movable in said cylinder between a first position in which the volume of a hydraulic space defined between the piston and a portion of the cylinder surface is a maximum and a second position in which the hydraulic space is a minimum, a valve member disposable over said portal, a stem coupling piston and said valve member so that said valve member is lifted off said portal to open said portal when said piston is moved from said first position toward said second position, and means, coupling said fuel supplying system to said hydraulic space, for delivering fuel to said hydraulic space to lift said piston and said valve member.

* * * * *